US007165436B2

(12) United States Patent
Bitz

(10) Patent No.: US 7,165,436 B2
(45) Date of Patent: Jan. 23, 2007

(54) CRIMP DIE LOCATOR

(75) Inventor: Steven R. Bitz, Mokena, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/009,671

(22) Filed: Dec. 10, 2004

(65) Prior Publication Data

US 2005/0126255 A1 Jun. 16, 2005

Related U.S. Application Data

(60) Provisional application No. 60/529,508, filed on Dec. 15, 2003.

(51) Int. Cl.
*H01R 43/042* (2006.01)
*B21D 28/00* (2006.01)

(52) U.S. Cl. ..... 72/409.14; 72/416; 72/461; 29/751; 29/753

(58) Field of Classification Search ..... 72/409.01, 72/409.16, 409.19, 416, 461; 29/237, 751, 29/753

See application file for complete search history.

(56) References Cited

U.S. PATENT DOCUMENTS

| | | | | |
|---|---|---|---|---|
| 2,556,725 | A | 6/1951 | Hurlbut | |
| 2,953,185 | A | 9/1960 | Lazar | |
| 3,032,603 | A | 5/1962 | Whitley | |
| 3,281,926 | A * | 11/1966 | Frastaci et al. | 72/409.19 |
| 3,402,452 | A * | 9/1968 | Mraz | 72/461 |
| 3,457,764 | A | 7/1969 | McKee | |
| 3,504,417 | A | 4/1970 | Filia | |
| 3,525,107 | A | 8/1970 | Hays | |
| 3,746,777 | A | 7/1973 | Peek | |
| 3,889,048 | A | 6/1975 | Groth | |
| 3,931,671 | A * | 1/1976 | Dittmann | 72/461 |
| 4,019,236 | A | 4/1977 | Osman | |
| 4,055,980 | A | 11/1977 | Churla | |
| 4,350,843 | A | 9/1982 | Campbell et al. | |
| 4,974,314 | A | 12/1990 | Nickerson et al. | |
| 5,162,615 | A | 11/1992 | Schrader et al. | |
| 5,377,400 | A * | 1/1995 | Homm | 72/416 |
| 5,421,186 | A | 6/1995 | Lefavour | |
| 5,428,983 | A | 7/1995 | Liu | |
| 5,635,676 | A | 6/1997 | Piriz | |
| 5,775,158 | A * | 7/1998 | Hensley et al. | 72/325 |
| 5,924,322 | A | 7/1999 | Caveney | |
| 6,227,030 | B1 | 5/2001 | Lefavour et al. | |
| 6,452,103 | B1 | 9/2002 | Piriz et al. | |
| 6,538,204 | B1 | 3/2003 | Connor | |
| 6,552,271 | B1 | 4/2003 | Connor et al. | |
| 6,769,173 | B1 | 8/2004 | Chadbourne | |
| 6,779,575 | B1 * | 8/2004 | Arthun | 72/409.19 |

FOREIGN PATENT DOCUMENTS

| | | |
|---|---|---|
| CH | 537 104 A | 5/1973 |
| FR | 1 328 133 A | 5/1963 |

* cited by examiner

*Primary Examiner*—David Jones
(74) *Attorney, Agent, or Firm*—Robert A. McCann; Christopher S. Clancy

(57) ABSTRACT

A compression connector crimp die is disclosed. The crimp die includes a first section and a second section. The first section connects the crimp die to a compression connector tool, and the second section is connected to the first section for crimping the connector. The first section also includes a locator mounted thereon.

5 Claims, 4 Drawing Sheets

CRIMP DIE LOCATOR

CROSS-REFERENCE TO RELATED APPLICATIONS

This application claims priority to U.S. Provisional Application Ser. No. 60/529,508, filed on Dec. 15, 2003, the entirety of which is hereby incorporated by reference.

BACKGROUND OF THE INVENTION

The present invention is directed to crimp dies and, more particularly, to locators mounted to compression connector crimp dies.

U.S. Pat. No. 3,032,603 discloses a connector having a spring clip 16 for temporarily holding cable in the connector before and during crimping to facilitate installation. U.S. Pat. No. 3,889,048 discloses a connector having clips 25, 37 for temporarily maintaining cables in the connector before and during crimping to facilitate installation. Moreover, crimping tools having locators for connectors are known in the art. However, none of these prior art connectors have locators mounted to connector crimp dies.

SUMMARY OF THE INVENTION

It would be desirable to provide a crimp die locator that positively positions an H-Tap compression connector in a crimp die prior to crimping.

It would also be desirable to provide a crimp die locator that minimizes poor H-Tap compression connector crimps.

A compression connector crimp die is disclosed. The crimp die includes a first section and a second section. The first section connects the crimp die to a compression connector tool, and the second section is connected to the first section for crimping the connector. The first section also includes a locator mounted thereon.

Preferably, the locator is removably mounted to the first section of the crimp die. Alternatively, the locator is permanently mounted to the first section of the crimp die.

Preferably, the locator radius of curvature is substantially identical to the die radius of curvature.

Preferably, the locator mounting hole is axially aligned with the die mounting hole.

DETAILED DESCRIPTION OF PREFERRED EMBODIMENTS

The illustrated embodiments of the invention are directed to locators mounted, either removably or permanently, to compression connector crimp dies. FIGS. 1–4 show a crimp die locator 20, and FIGS. 5–10 show crimp die locator 20 mounted to a crimp die 22. Preferably, crimp die locator 20 is made of electrically conductive material, such as copper. However, it is likewise contemplated that crimp die locator 20 may be made of other suitable materials or elements.

Figure 1:
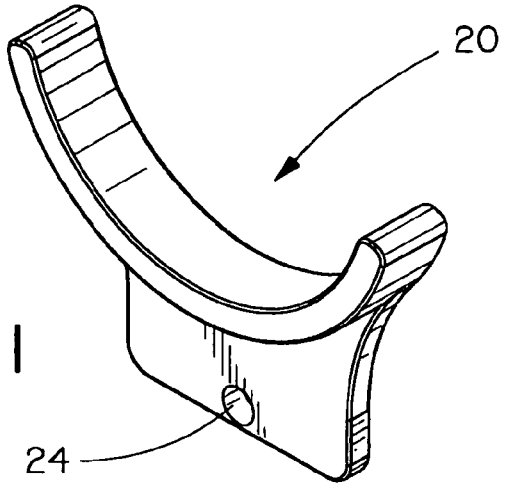
FIG. 1 is a front perspective view of a crimp die locator according to the present invention.
Figure 2:
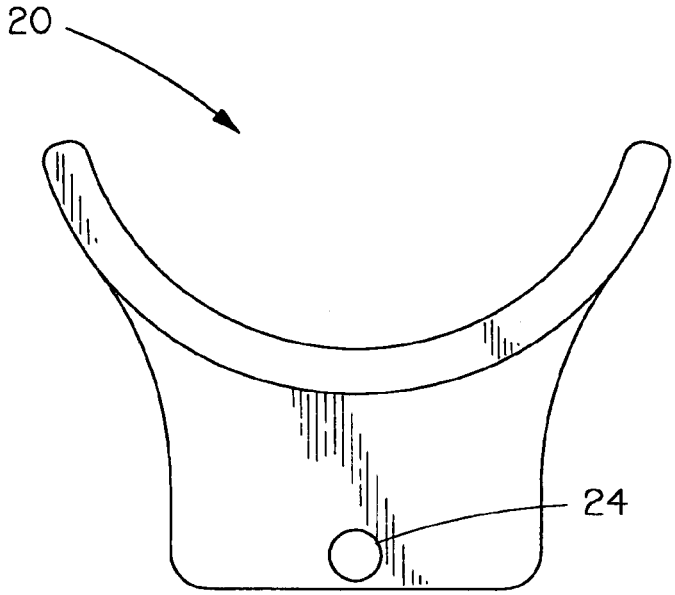
FIG. 2 is a front view of the crimp die locator of FIG. 1.
Figure 3:
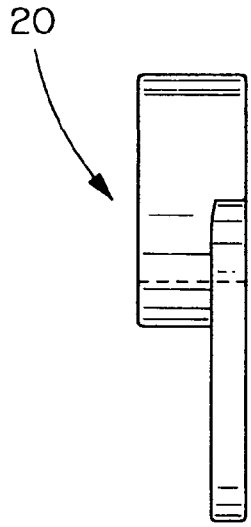
FIG. 3 is a right side view of the crimp die locator of FIG. 1.
Figure 4:
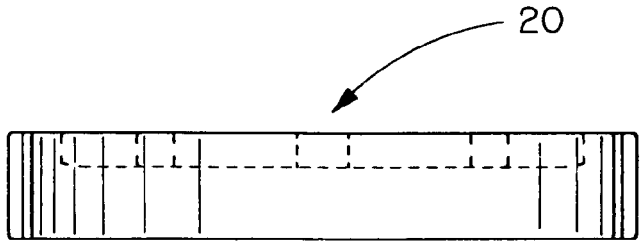
FIG. 4 is a top view of the crimp die locator of FIG. 1.
Figure 7:
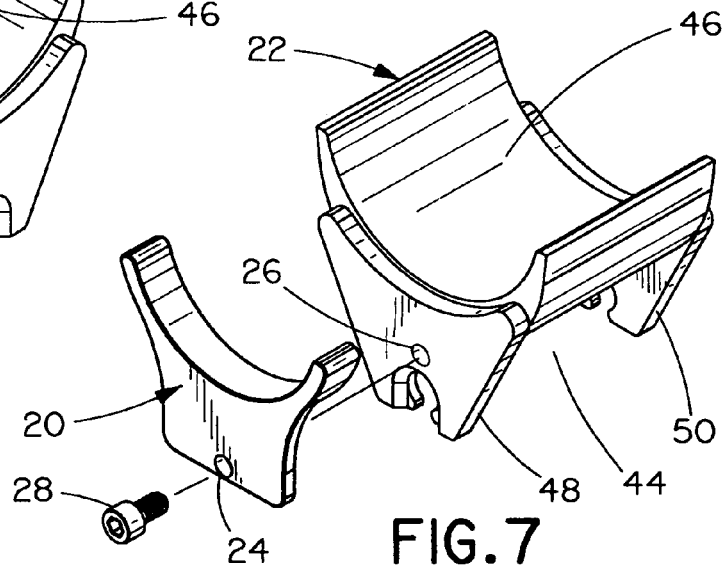
FIG. 7 is a front perspective view of the crimp die of FIG. 5, shown prior to mounting the locator thereon.
Figure 10:
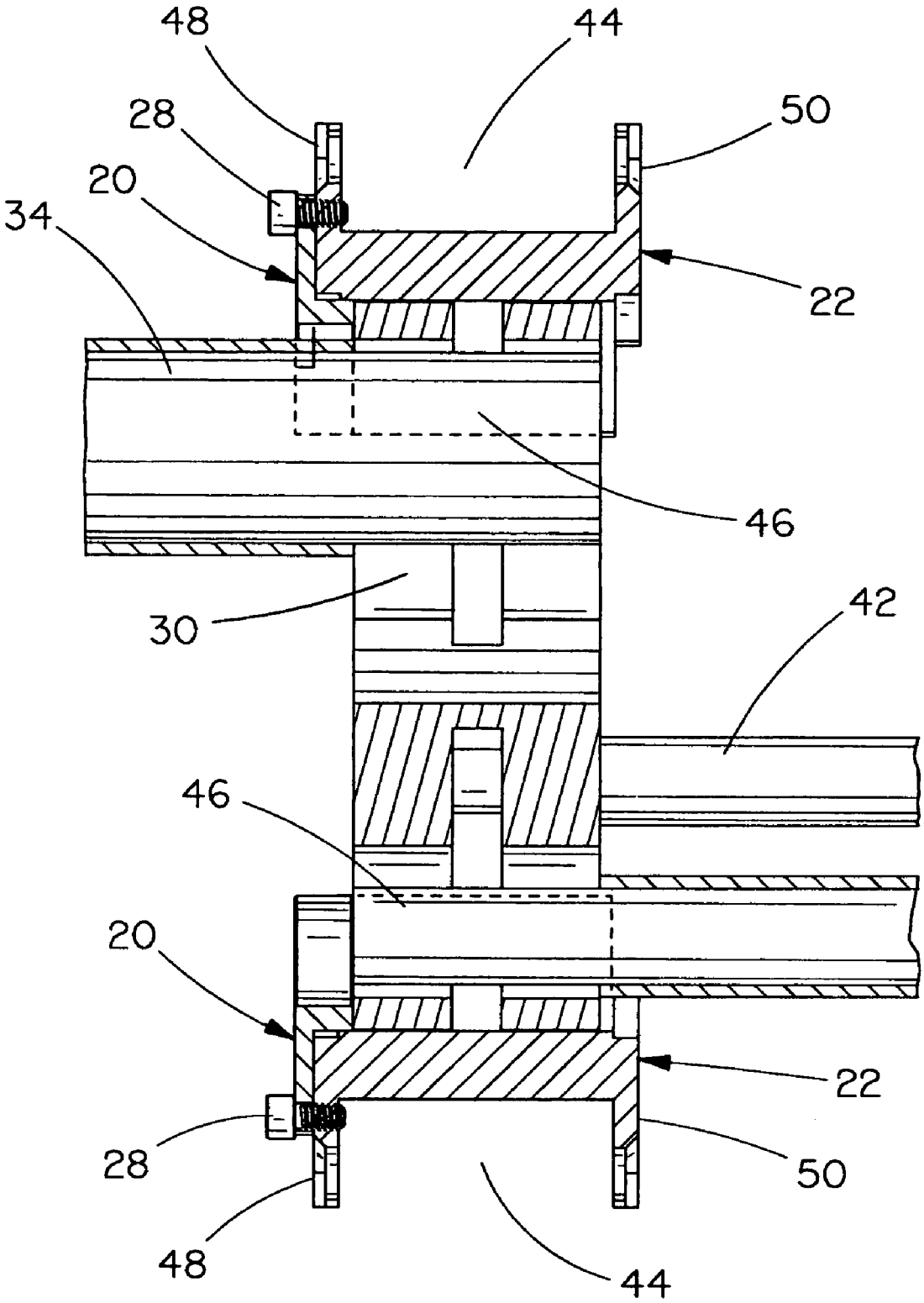
FIG. 10 is a cross-sectional view taken along lines 10—10 of FIG. 8.

As shown in FIGS. 1 and 2, crimp die locator 20 has a mounting hole 24 for securing crimp die locator 20 to crimp die 22. Moreover, as best seen in FIG. 7, crimp die 22 also has a mounting hole 26, and mounting hole 26 is axially aligned with mounting hole 24. Mounting holes 24 and 26 receive screw 28 to secure crimp die locator 20 to crimp die 22, as best seen in FIG. 10.

Figure 6:
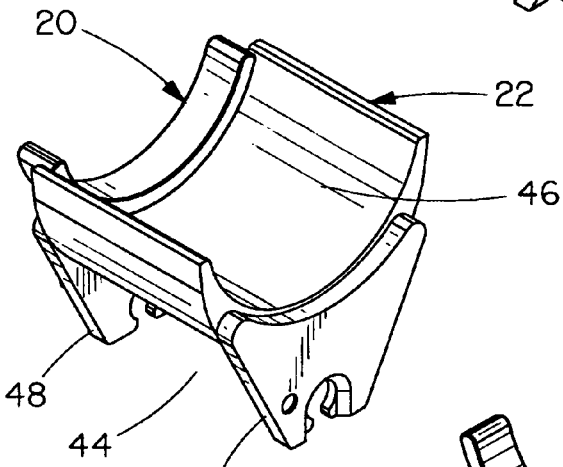
FIG. 6 is a rear perspective view of the crimp die of FIG. 5, shown having a locator mounted thereon.
Figure 9:
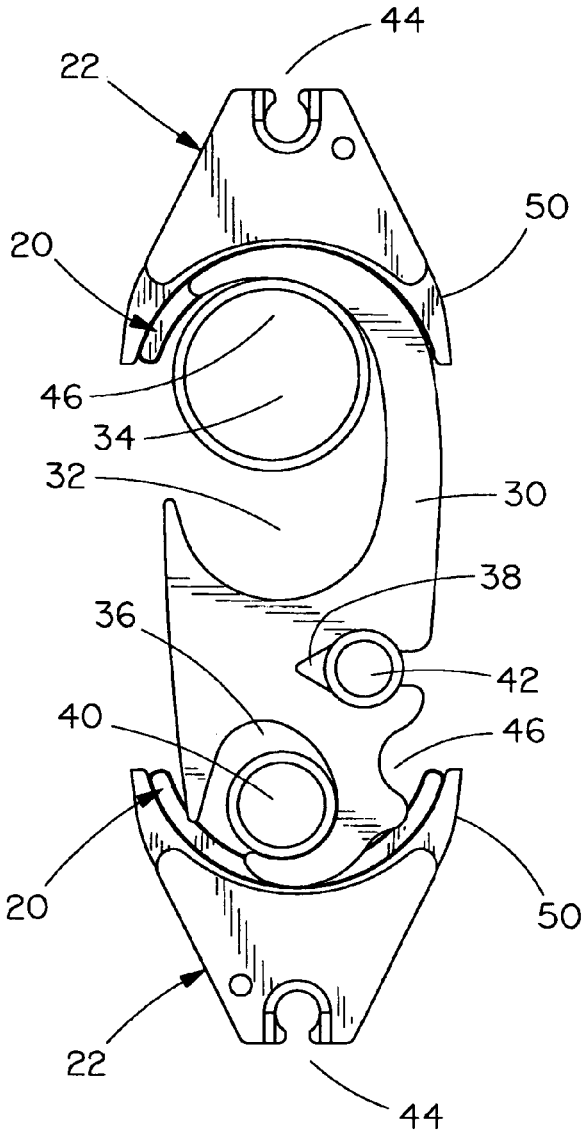
FIG. 9 is a rear view of the crimp die locator of FIG. 1, shown mounted to a crimp die prior to crimping a compression connector.

As best seen in FIG. 9, crimp die locator 20 has a radius of curvature similar to the radius of curvature of crimp die 22. Thus, an outside surface of crimp die locator 20 is in continuous contact with an inside surface of crimp die 22, as shown in FIGS. 6 and 9. Crimp die locator 20 allows for positive positioning while crimping H-Tap compression connectors, such as compression connector 30 which is illustrated in FIGS. 33–40 of U.S. application Ser. No. 10/981,371, filed on Nov. 4, 2004, the entirety of which is hereby incorporated by reference. It is likewise contemplated that crimp die locator 20 may be used to position any H-Tap compression connector. Crimp die locator 20 also allows consistent and accurate placement of compression connector 30 in crimp die 22, which creates equal pressure during crimping and minimizes poor crimps as well as jams with the crimp tool (not shown). This is especially important in difficult applications, such as under floor or overhead crimp locations.

Figure 5:
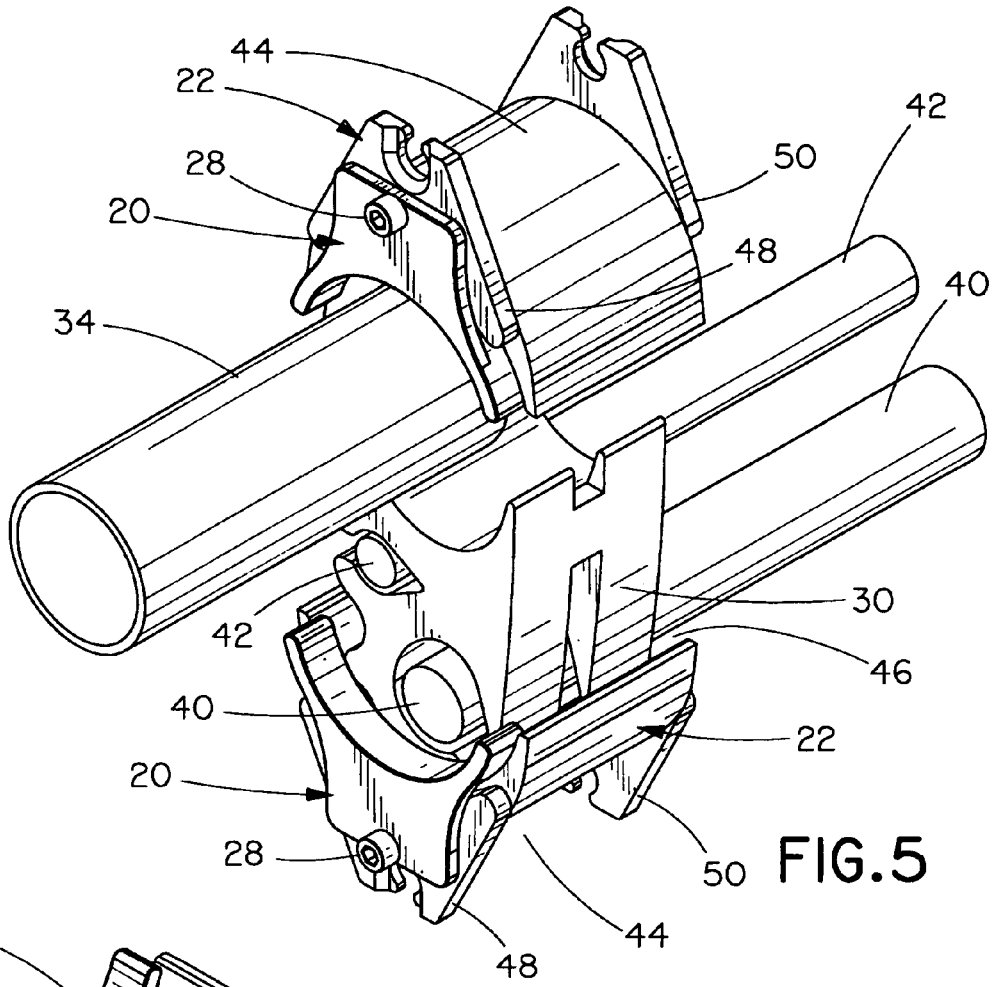
FIG. 5 is a front perspective view of the crimp die locator of FIG. 1, shown mounted to a crimp die prior to crimping a compression connector.
Figure 8:
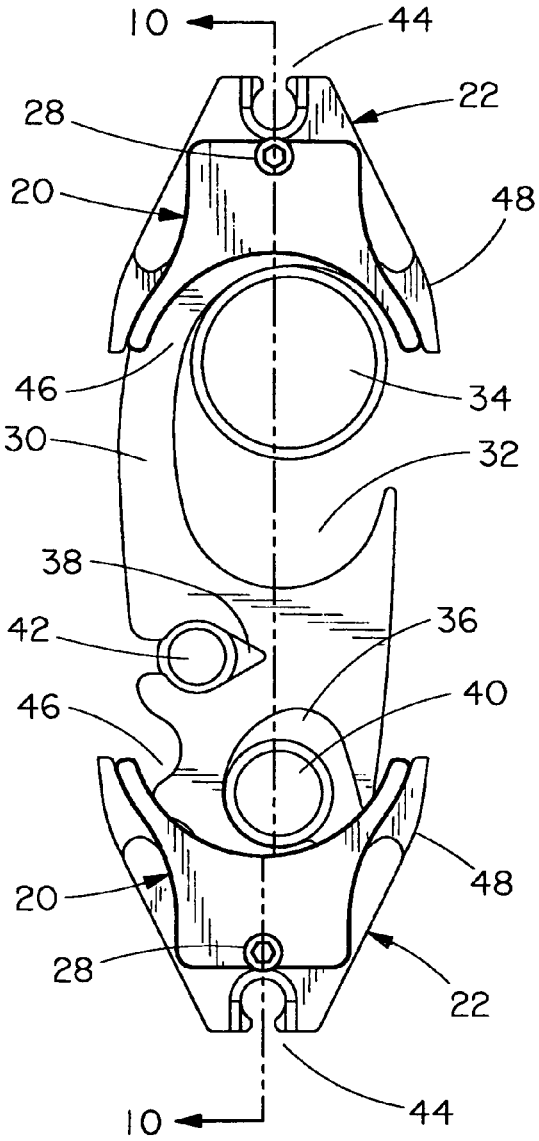
FIG. 8 is a front view of the crimp die locator of FIG. 1, shown mounted to a crimp die prior to crimping a compression connector.

Compression connector 30 is crimped using a crimp tool fitted with a pair of crimp dies 22, such as a Panduit® PH75 Crimp Die. As best seen in FIGS. 5 and 8, each crimp die 22 has a crimp die locator 20 removably mounted thereon. Alternatively, crimp die locator 20 may be permanently mounted to crimp die 22. This configuration will eliminate the possibility of crimp die locator 20 loosening from crimp die 22 over time. Moreover, as shown in FIGS. 5, 8 and 9, compression connector 30 has a main wire port 32 for receiving main line wires 34, and tap wire ports 36, 38 for receiving tap wires 40, 42, respectively. As best seen in FIGS. 6 and 7, crimp die 22 has a first section 44 and a second section 46. First section 44 connects crimp die 22 to the crimp tool, and first section 44 has a pair of spaced legs 48. Legs 48 extend from a rear end of second section 46.

In operation, two crimp die locators 20 are removably mounted to two crimp dies 22 utilizing 6–32¼ inch long socket head cap screws. It is likewise contemplated that crimp die locators 20 may be mounted to crimp dies 22 using any known fastener. Alternatively, crimp die locators 20 may be made integral with crimp dies 22. For example, crimp die locators 20 may be cast molded with crimp dies 22. Compression connector 30 is then positioned within crimp dies 22, and main line wires 34 and tap wires 38, 40 are positioned within main wire port 32 and tap wire ports 36, 38, respectively. Compression connecter 30 is crimped using a crimp tool.

The disclosed invention provides locators mounted, either removably or permanently, to compression connector crimp dies. It should be noted that the above-described illustrated embodiments and preferred embodiments of the invention are not an exhaustive listing of the form such a crimp die locator in accordance with the invention might take; rather, they serve as exemplary and illustrative of embodiments of the invention as presently understood. Many other forms of the invention are believed to exist.

The invention claimed is:

1. A compression connector crimp die comprising:

a first section for connecting the die to a compression connector tool, wherein the first section includes a locator mounted thereon; and a second section connected to the first section for crimping a connector, wherein the locator has a radius of curvature and the die has a radius of curvature, the locator radius of curvature is substantially identical to the die radius of curvature.

2. The crimp die of claim 1, wherein the locator is removably mounted to the first section of the die.

3. The crimp die of claim 1, wherein the locator is permanently mounted to the first section of the die.

4. The crimp die of claim 1, further including a mounting hole.

5. The crimp die of claim 4, wherein the locator includes a mounting hole axially aligned with the die mounting hole.

* * * * *